US007100938B2

(12) United States Patent
Krumbeck et al.

(10) Patent No.: US 7,100,938 B2
(45) Date of Patent: Sep. 5, 2006

(54) DISENGAGEABLE SKI BINDING

(75) Inventors: Markus Krumbeck, Garmisch-Partenkirchen (DE); Michael Mangold, Farchant (DE); Andreas Mann, Garmisch-Partenkirchen (DE)

(73) Assignee: Marker Deutschland GmbH, Eschenlohe (DE)

( * ) Notice: Subject to any disclaimer, the term of this patent is extended or adjusted under 35 U.S.C. 154(b) by 178 days.

(21) Appl. No.: 10/723,336

(22) Filed: Nov. 26, 2003

(65) Prior Publication Data

US 2004/0155432 A1 Aug. 12, 2004

(30) Foreign Application Priority Data

Nov. 27, 2002 (DE) ..... 102 55 499

(51) Int. Cl.
*A63C 9/00* (2006.01)

(52) U.S. Cl. ..... 280/611; 280/613; 280/617

(58) Field of Classification Search ..... 280/11.3, 280/11.31, 11.33, 611, 613, 617, 618, 626, 280/629

See application file for complete search history.

(56) References Cited

U.S. PATENT DOCUMENTS 3,918,732 A * 11/1975 Wulf ..... 280/618
4,026,576 A * 5/1977 Frechin ..... 280/613
4,182,524 A 1/1980 Beyl
4,191,395 A * 3/1980 Salomon ..... 280/613
4,893,831 A * 1/1990 Pascal et al. ..... 280/618
5,762,357 A * 6/1998 Ratzek et al. ..... 280/607
6,338,497 B1 * 1/2002 Chevalier et al. ..... 280/612
6,428,032 B1 * 8/2002 Humbel ..... 280/613
6,773,024 B1 * 8/2004 Walkhoff ..... 280/613

* cited by examiner

*Primary Examiner*—Christopher P. Ellis
*Assistant Examiner*—Brian P Swenson
(74) *Attorney, Agent, or Firm*—D. Peter Hochberg; Sean Mellino

(57) ABSTRACT

Disengageable ski binding having a carrying plate which is provided as a standing surface for a ski boot and is arranged on a ski-mounted base part such that it can be rotated about a vertical axis of the base part counter to an adjustable resistance of a first latching device, and having disengageable front and rear sole holders which are arranged on the carrying plate, it being the case that the rear sole holders can be disengaged counter to an adjustable resistance of a second latching arrangement, which is separate from the first latching device, and/or the front sole holders are locked within a predetermined angle-of-rotation region of the carrying plate, without affecting the resistance of the first latching device, and are unlocked outside the region of rotation.

13 Claims, 6 Drawing Sheets

DISENGAGEABLE SKI BINDING

BACKGROUND OF THE INVENTION

1. Field of the Invention

The invention relates to a disengageable ski binding.

1. Description of the Prior Art

In the case of virtually all ski bindings which are currently available on the market, a front boot-retaining unit and a rear boot-retaining unit are arranged on the ski, the front boot-retaining unit interacting in a form-fitting manner with the toe end, and the rear boot-retaining unit interacting in a form-fitting manner with the heel end, of the "standard" sole of a ski boot. To be precise, the front boot-retaining unit prevents the toe end of the sole from moving forward in the longitudinal direction of the ski and from moving in the direction of the vertical and transverse axes of the ski, while the rear boot-retaining unit secures the heel end of the sole against moving rearward in the longitudinal direction of the ski and against moving in the direction of the vertical and transverse axes of the ski.

Such bindings have reached a high standard of development and a high level of reliability. In principle, however, they have the disadvantage that any dirt which accumulates between the soles and boot-retaining units may influence the disengaging behavior.

Consequently, U.S. Pat. No. 4,182,524 has already developed ski bindings in the case of which the ski boot stands on a standing and/or carrying plate of the binding, it being possible for this plate to be rotated about a vertical ski axis counter to an adjustable resistance. With the boot inserted into the binding, the boot sole is fixed on the carrying plate by means of boot-retaining elements on the plate, which interact with mating elements on the sole.

If the skier' boot or foot tries to execute a rotary movement with respect to the vertical axis of the ski when the skier falls, the resistance to rotation which is to be overcome during this rotary movement is determined, in the case of a binding according to U.S. Pat. No. 4,182,524, exclusively by elements of the binding which can be arranged, in principle, such that they are protected against dirt, for example, according to U.S. Pat. No. 4,182,524, within the standing and/or carrying plate.

Nevertheless, the binding according to U.S. Pat. No. 4,182,524 still does not have a satisfactorily reproducible behavior. The resistance to rotation which counteracts rotation of the standing and/or carrying plate about the vertical axis is determined by a spring arrangement which also gives rise to the disengaging resistance of the boot-retaining elements on the plate. The arrangement here is such that, during rotation of the standing and/or carrying plate about the vertical axis, the boot-retaining elements attain an increasing clearance for movement in the direction of their boot-releasing position. Conversely, the standing and/or carrying plate attains a clearance for rotation as soon as the boot-retaining elements are adjusted in the direction of their boot-releasing position by relative movements between the standing and/or carrying plate and boot sole. It is thus possible for dirt which is found between the standing and/or carrying plate and boot sole to influence, on the one hand, the disengaging behavior of the binding and, on the other hand, the restoring behavior of the binding within its so-called region of elasticity, within which disruptive forces acting on the binding result in movements of the binding elements or parts, but not in the binding being disengaged, with the result that, as the disruptive force dissipates again, the binding can be restored into the normal state, in which the boot is fixed in a predetermined desired position.

SUMMARY OF THE INVENTION

It is an object of the invention, then, in the case of a ski binding, to ensure disengaging and elasticity behavior which can be reproduced to particularly good effect.

This object is achieved according to the invention by a disengageable ski binding having a standing and/or carrying plate which is provided as a standing surface for a ski boot and is arranged on a base or bearing part, which is mounted on the ski and/or can be fitted firmly on the ski, such that it can be rotated about a vertical axis of the base part counter to an adjustable resistance of a first latching device, and having disengageable front and rear boot or sole holders which are arranged on the standing and/or carrying plate and which, in a use position, interact in a form-fitting manner with mating surfaces or elements on the boot or boot sole and fix these essentially firmly on the standing and/or carrying plate, it being the case that the rear sole holders, in the case of disruptive forces which raise up the boot vertically from the standing and/or carrying plate, can be adjusted into a release position counter to an adjustable resistance of a second latching arrangement, which is separate from the first latching device, and/or the front boot or sole holders are locked within a predeterminable angle-of-rotation region of the standing and/or carrying plate in respect of the vertical axis, at least essentially without affecting the resistance of the first latching device, and are unlocked outside the region of rotation.

The invention is based on the general idea of ruling out any critical relative movement between the boot sole and standing and/or carrying plate within the region of elasticity of the binding. This is achieved, in the first instance, in that rotary movements of the standing and/or carrying plate about the vertical axis which are caused by disruptive forces, on account of the first and second latching devices being separate from one another and of the initially maintained locking of the front boot and/or sole holders, cannot result in any play, in particular clearance for rotation, of the boot sole relative to the standing and/or carrying plate. Within the region of elasticity, the rotary movement of the carrying and/or standing plate does not have any effect on the position of the boot and/or sole holders relative to the standing and/or carrying plate.

It should be emphasized here that the rear sole holders, according to a preferred embodiment of the invention, can be disengaged only in the vertical direction, i.e. by forces which try to raise up the heel region of the boot vertically from the standing and/or carrying plate. Accordingly, there is no possibility of any displacements between the sole and standing and/or carrying plate in the heel region if disruptive forces give rise to a torque between the boot and ski in respect of the vertical axis.

If any disruptive forces try to raise up the boot vertically from the standing and/or carrying plate, with adjustment of the rear boot holder in the direction of the disengagement state, it is not possible for any dirt between the standing and/or carrying plate and boot sole to have a disruptive influence.

According to a quite particularly preferred embodiment of the invention, the standing and/or carrying plate is assigned a torque support by means of which torques which act on the standing and/or carrying plate in respect of a transverse plate axis are converted into torques in respect of the vertical axis, and a moment which assists further rotation of the standing and/or carrying plate about the vertical axis is produced as soon as the standing and/or carrying plate has left a central position or a central position region. This makes it possible to allow for the fact that torsional loading of the shin and of the ankles and knee joints are to be reduced when the leg is subjected to additional stressing by further forces such as those which typically arise when the skier falls in the forward or rearward direction. Because of the abovementioned torque support, the disruptive forces which are responsible for further stressing are thus used in order to reduce the resistance to rotation which counteracts rotation of the standing and/or carrying plate about the vertical axis, with the result that a rotary displacement of the standing and/or carrying plate which unlocks the front boot or sole holders, and thus release of the boot, are achieved relatively easily.

In addition, as far as preferred features of the invention are concerned, the claims and the following explanation of the drawing illustrate these, with reference to which a particularly preferred embodiment and a number of possible modifications are described in more detail. Protection is claimed here not just for combinations of features which are expressly given in the claims or the description, but also for basically any desired sub-combinations of the features illustrated.

DESCRIPTION OF THE DRAWINGS

The invention may take physical form in certain parts and arrangement of parts, a preferred embodiment of which will be described in detail in the specification and illustrated in the accompanying drawings which forms a part hereof, and are not meant to limit same, and wherein.

DESCRIPTION OF THE PREFERRED EMBODIMENTS

Figure 2:
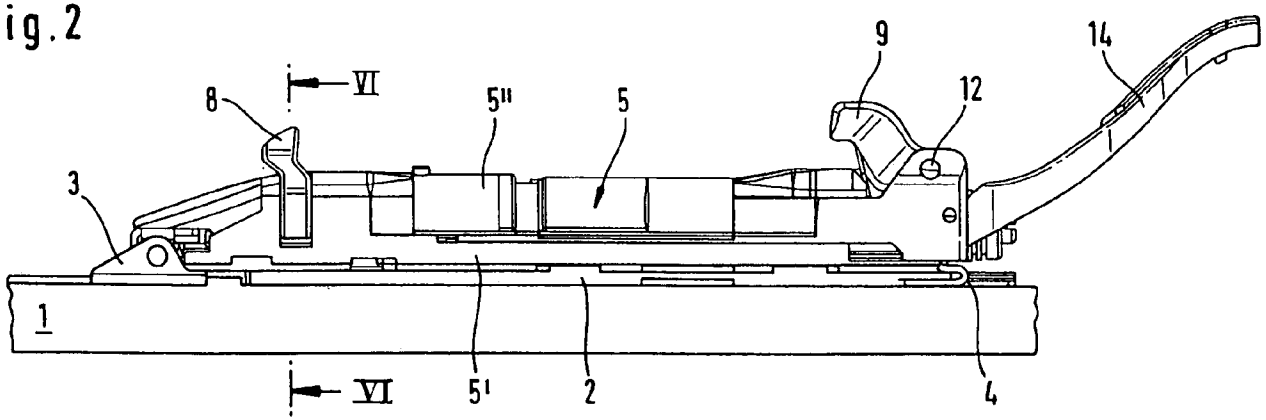
FIG. 2 shows an associated side view.

The binding according to the invention has a base plate 2 which is arranged on a ski 1, indicated partly in FIG. 2, which is connected at its front end, as seen in the longitudinal direction of the ski, in a hinge-like manner to a bearing part 3, arranged firmly on the ski, such that it can be pivoted about a transverse ski axis, and which is secured vertically, with displaceability in the longitudinal direction of the ski, at its rear end, as seen in the longitudinal direction of the ski, in a further ski-mounted bearing part 4.

Arranged on the base plate 2 is a standing and/or carrying plate 5, which can be rotated about a vertical axis of the base plate 2 and of which the top side serves as a standing and/or supporting surface for the sole of a ski boot which is to be inserted into the ski binding. The standing and/or carrying plate 5 has a bottom plate part 5', designed as a frame and structural part, and a covering part 5" on the top side. The abovementioned connection between the base plate 2 and standing and/or carrying plate 5, it being possible for said connection to be pivoted about a vertical axis, is arranged between the base plate 2 and the bottom plate part 5', it being possible for the pivot bearing to be formed, for example, by an elevation in the form of a circular disk being integrally formed on the underside of the bottom plate part 5', said elevation engaging in a correspondingly circular recess in the base plate 2 and being connected firmly to a flange plate 6 (see FIG. 3) which is arranged on the underside of the base plate and overlaps the abovementioned circular recess of the base plate 2 in the radially outward direction.

Figure 1:
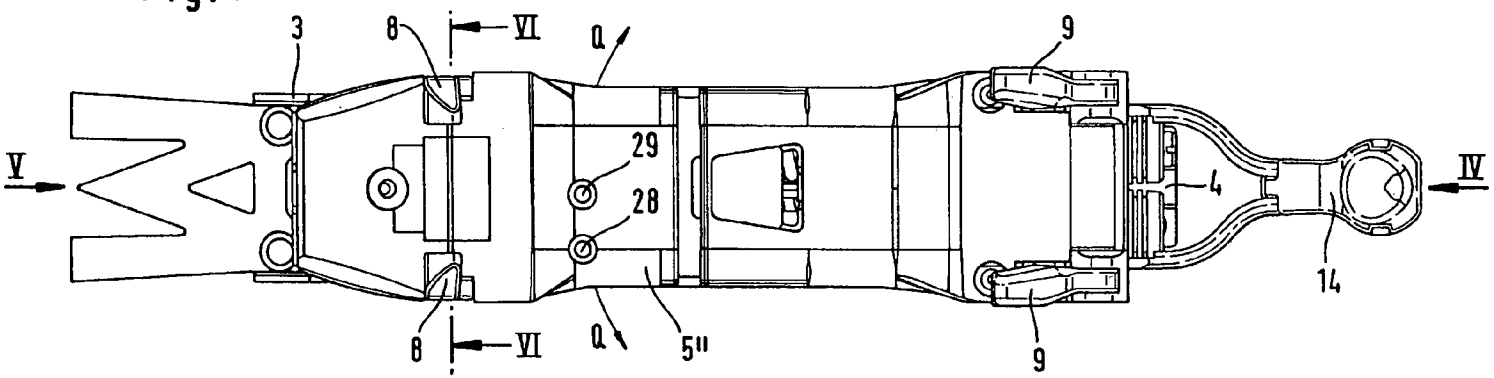
FIG. 1 shows a plan view of the top side of a binding according to the invention.
Figure 3:
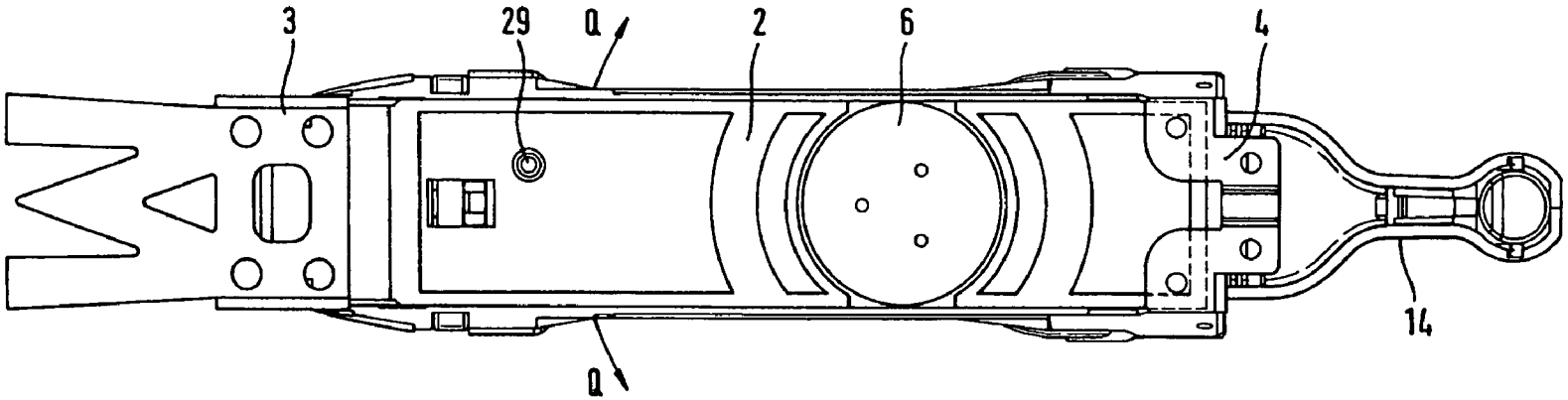
FIG. 3 shows an associated plan view of the underside of the binding.
Figure 5:
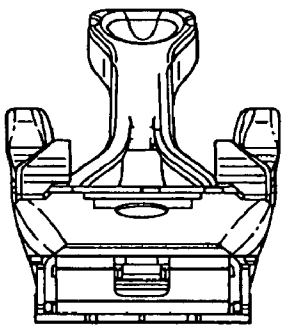
FIG. 5 shows a front view of the binding according to the arrow V in FIG. 1.
Figure 4:
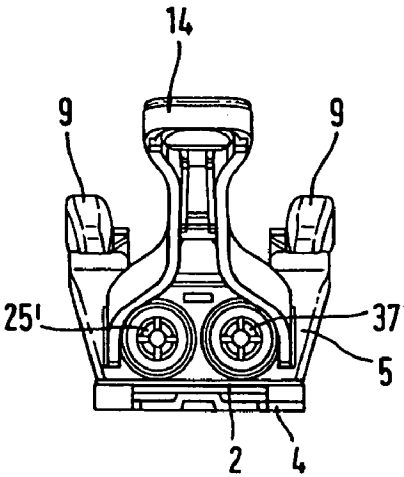
FIG. 4 shows a rear view of the binding according to the arrow IV in FIG. 1.

The standing and/or carrying plate 5 (see FIG. 2) is kept in the central position, which is illustrated in FIGS. 1 and 3, by a first latching device 7, which is explained in more detail below. The carrying plate 5 can be rotated relative to the longitudinal axis of the ski and/or of the base plate 2, counter to the resistance of the abovementioned latching device 7, corresponding to the arrows Q in FIGS. 1 and 3.

Figure 10:
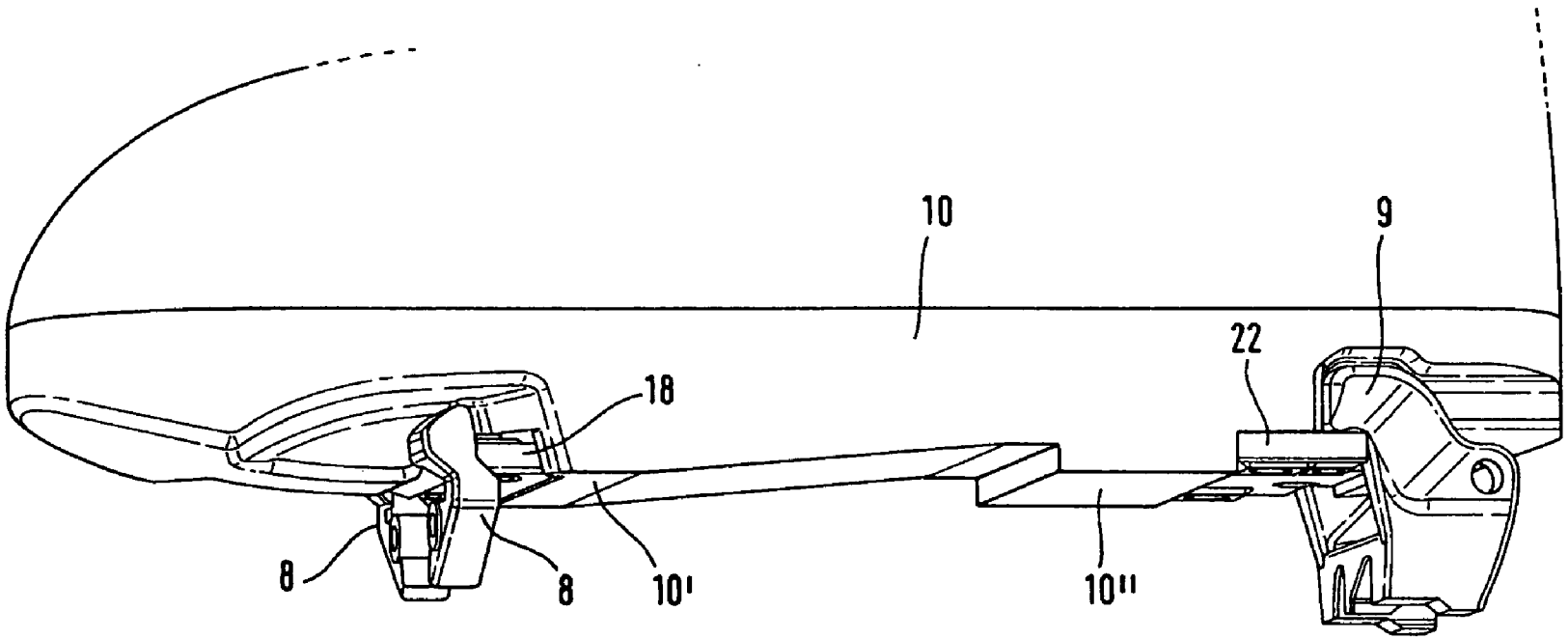
FIG. 10 shows a perspective illustration of the underside of the sole and of the front and rear sole holders interacting with fitting parts on the sole.

Front and rear sole holders 8 and 9 are arranged on the standing and/or carrying plate 5, and the sole 10 of a boot inserted into the binding is fixed in a virtually immovable manner on the standing and/or carrying plate 5 by means of said sole holders in their use position (see, for example, FIGS. 1, 2 and 10).

In the embodiment of FIGS. 1, 2 and 10, the front sole holders 8 can be pivoted into a release position, to the side of the standing and/or carrying plate 5, about axes 11 (see FIG. 6) extending in the longitudinal direction of the standing and/or carrying plate 5, while the rear sole holders 9 can be tilted into a release position about an axis 12 extending in the transverse plate direction.

As is described in more detail below with the explanation of the first latching device 7, the front sole holders 8 are locked in their use position when the standing and/or carrying plate 5 assumes its normal position according to FIGS. 1 and 3 or a position within a pivoting region which is provided for the region of elasticity of the binding and is located on both sides of the normal position. As soon as this pivoting region is exceeded to the right or left, the front sole holders 8 are unlocked, with the result that they can readily be swung or moved into their release position.

The rear sole holders 9 can interact with a second latching device 13, which is explained in more detail below, and with an actuating lever 14. In the case of corresponding disruptive forces or moments acting on the rear sole holders 9, the rear sole holders 9 are tilted, in the clockwise direction in FIG. 2, in a self-retaining release position. It is also possible for the rear sole holders 9 to be changed over between the use position and release position by the actuating lever 14, or for the rear sole holders to interact with the first latching device 7.

Figure 9:
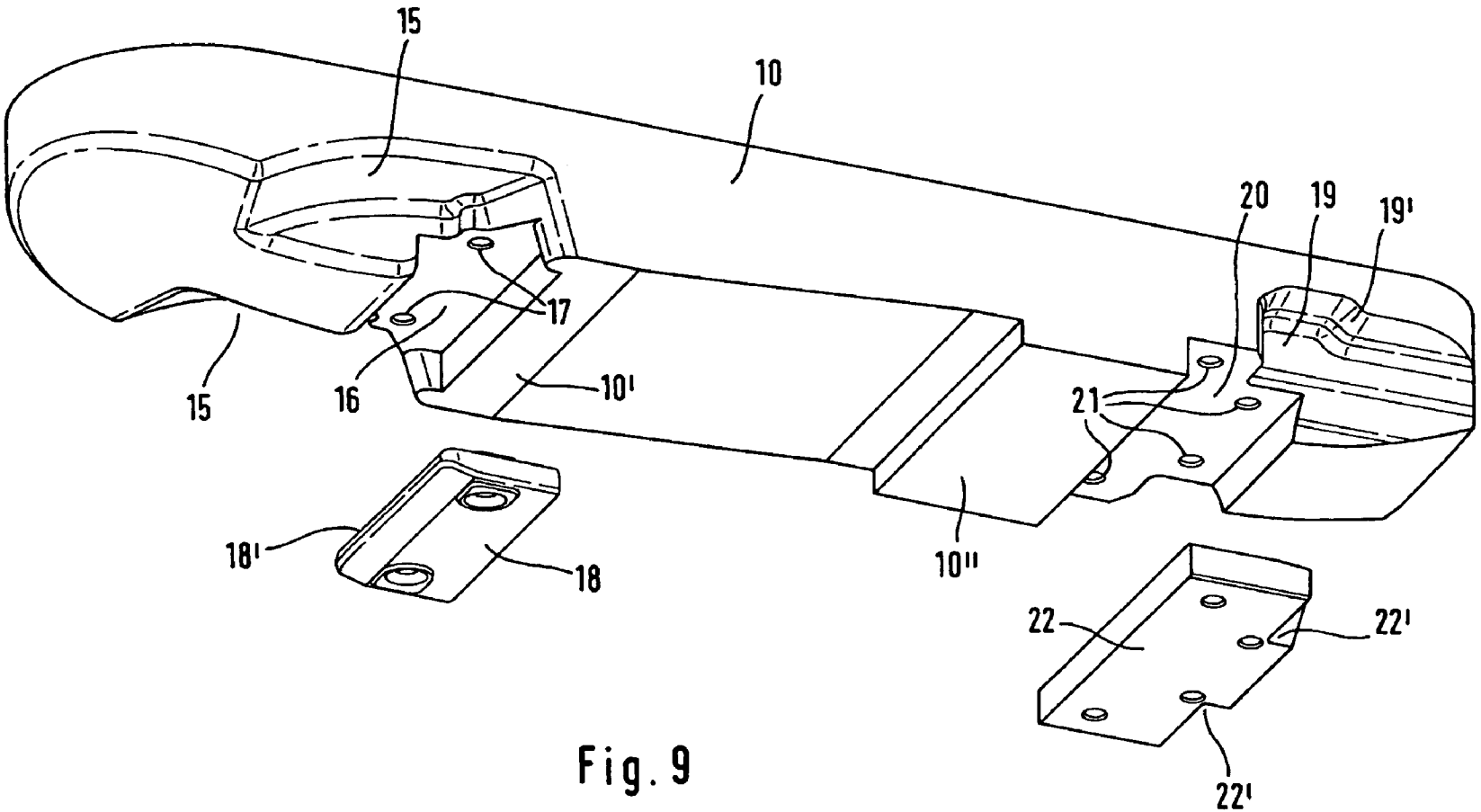
FIG. 9 shows a perspective exploded illustration of the underside of a ski-boot sole interacting with the binding according to the invention.

According to FIGS. 9 and 10, the sole 10 of the ski boot which is to be inserted into the binding has, approximately in the ball-of-the-foot region and/or at a relatively large distance from the toe end of the sole, recesses 15, which are open in relation to the underside of the sole and in relation to the longitudinal borders of the sole, and a depression 16, which is open in the downward direction and in relation to the abovementioned recesses 15 and has a planar base which is provided with accommodating bores 17 for screws or the like. A fitting plate 18 is arranged in the depression 16 and fastened by screws or the like (not illustrated), which are screwed into the accommodating bores 17. The fitting plate 18 has a slightly wedge-shaped front edge 18', of which the corner regions are accommodated in a form-fitting manner by corresponding recesses of the front sole holders 8 when the front sole holders 8 assume their use position and the sole 10 is pushed, by way of the front edge 18' of the fitting plate 18, into the abovementioned recesses of the sole holders 8 in the longitudinal direction of the sole, the sole 10 being seated flatly, by way of an underside region 10' adjacent to the fitting plate 18, on the top side of the standing and/or carrying plate 5 in the vicinity of the front sole holders 8.

The abovementioned form fit between the corner regions of the front edge 18' of the fitting plate 18 and the recesses of the front sole holders 8 is designed such that the sole 10 is secured and/or arrested against displacement in the forward, sideways and vertical directions.

The rear region of the sole 10 contains recesses 19 which are open in the downward direction and in relation to the side borders of the sole 10 and merge into a depression 20 which is remote from the rear sole end, is open in the direction of the recesses and in the direction of the underside of the sole and has a planar base with accommodating bores 21 for screws or the like. A fitting plate 22 is arranged in this depression 20 and fixed by screws or the like (not illustrated), which are screwed into the abovementioned accommodating bores 21. The fitting plate 22 is T-shaped in plan view, such that angled indents 22' are formed in the fitting plate 22.

In their use position, the rear sole holders 9, with the boot inserted into the binding, engage over the upwardly oriented side of the fitting plate 22 from above in the region of the indents 22', in which case those borders of the indents 22' which extend in the longitudinal direction of the sole butt against the mutually facing flanks of the rear sole holders 9 and those borders of the indent 22' which extend in the transverse direction of the sole butt against the front borders of the rear sole holders 9, these borders being essentially vertical in the use position, and an underside region 10" of the sole 10, which extends in front of the fitting plate 22, rests flatly on the top side of the standing and/or carrying plate 5 in the vicinity of the rear sole holders 9. Accordingly, by virtue of a form fit between the fitting plate 22 and the rear sole holders 9, the rear sole region is secured against movement in the rearward, sideways and vertical directions.

The sole 10 need be of rigid design essentially only between the fitting plates 18 and 22, such that the fitting plates 18 and 22 are always in a reproducible position in relation to the regions 10' and 10" on the underside of the sole 10 and, accordingly, can interact with the sole holders 8 and 9 with a play-free form fit. The sole regions in front of and behind the fitting plates 18 and 22 may be formed, for the most part, as desired. In particular, it is possible for the underside of the sole to be curved in these regions so as to facilitate a rolling movement of the foot during walking.

Figure 7:
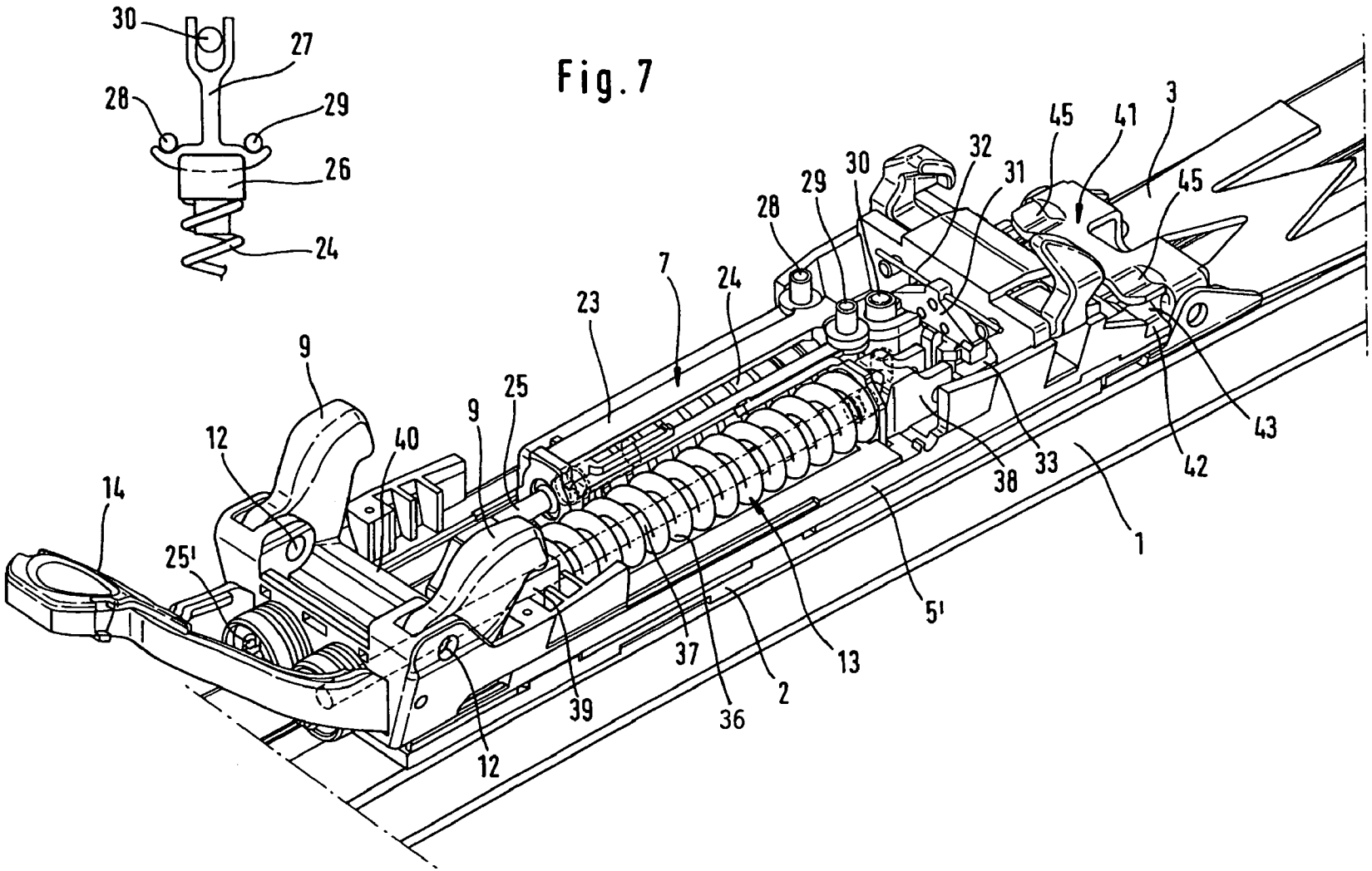
FIG. 7 shows a perspective plan view of the binding according to the invention with the standing and/or carrying plate open on the top side.

The first latching device 7, according to FIG. 7, has a spring housing 23, which is arranged firmly on the bottom plate part 5' of the standing and/or carrying plate 5 and accommodates a helical compression spring 24. One end of the helical compression spring 24 is supported on a spring abutment, which can be adjusted in the longitudinal direction of the spring housing 23 by means of an adjusting screw 25, with the result that it is possible to change the spring stressing by means of a screwing tool which can be attached to the head 25' of the adjusting screw 25, said head being accessible at the rear border of the standing and/or carrying plate 5. The other end of the helical compression spring 24, according to the separate detail-form illustration in FIG. 7, is held under stressing against a piston 26, which can be displaced in the spring housing 23 and, for its part, is held under stressing, by the spring force, against a facing transverse member of a tilting lever 27, said transverse member of the tilting lever 27 engaging in a transverse slot on the facing side of the piston 26. The transverse member of the tilting lever 27 interacts with tilting pins 28 and 29, which are firmly arranged as parts of the spring housing 23 and around which the transverse member of the tilting lever 27, in the normal position thereof, engages by way of corresponding, approximately semicircular recesses. The helical compression spring 24 and the piston 26 on which the latter acts try to keep the transverse member of the tilting lever 27 in abutment against the two tilting pins 28 and 29. If the tilting lever 27 is pivoted about one of the tilting pins 28 or 29 by corresponding forces, the piston 26 is forced back counter to the force of the helical compression spring 24 as soon as the tilting lever 27 is subjected to a moment which overcomes the prestressing of the helical compression spring 24.

The tilting lever 27 engages, by way of a fork-like end, around a pin 30 which is firmly arranged on the base plate 2. Correspondingly, the tilting lever 27 has to be deflected out of its normal position, which is illustrated in FIG. 7, with pivoting about the tilting pin 28 or 29, when the standing and/or carrying plate 5 on the base plate 2 executes a rotary movement about the vertical axis passing centrally through the flange plate 6 (see FIG. 3).

As a result, it is thus only possible for the standing and/or carrying plate 5 to execute a rotation about the abovementioned vertical axis on the base plate 2 when the standing and/or carrying plate 5 is subjected to a sufficient torque, the magnitude of which is determined by the prestressing of the helical compression spring 24. As soon as this torque is exceeded, the standing and/or carrying plate 5 is pivoted to a more or less great extent.

On a part which is connected firmly to the bottom plate part 5' of the standing and/or carrying plate 5, a yoke 31 is arranged such that it can be pivoted about a longitudinal plate axis. A leg spring 32 forces the yoke 31 into the normal position, which is illustrated in FIG. 7. The ends of the yoke 31 interact, in the manner of cams, with a guide track or guide curve 33 firmly arranged on the base plate 2, such that the yoke 31 executes a pivoting movement in one direction or the other when the standing and/or carrying plate 5 is pivoted relative to the base plate 2 in one direction or the other.

Figure 6:
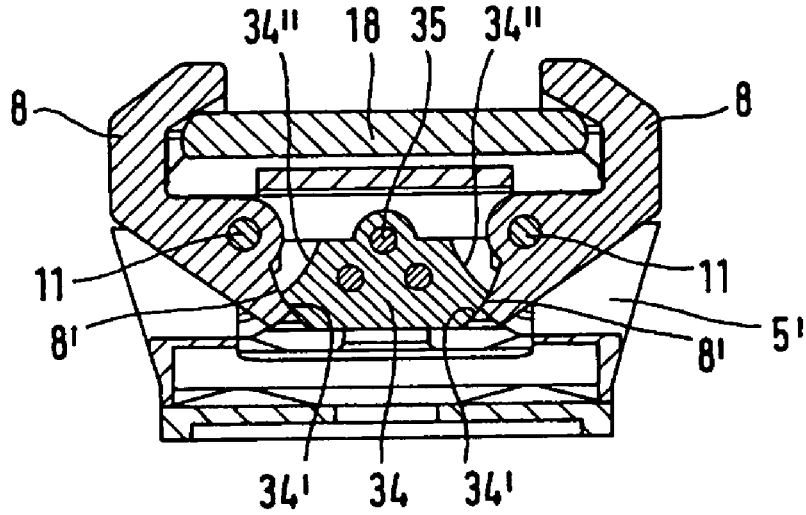
FIG. 6 shows a sectional view corresponding to section line VI—VI in FIGS. 1 and 2.

The yoke 31 is coupled in a rotationally fixed manner to a control plate 34, which can be seen in FIG. 6 and has circle-arc-shaped border sections 34' located centrally in relation to the pivot pin 35, and adjoining border sections 34" which are located more or less radially in relation to the pivot pin 35.

In the normal position of the yoke 31 and of the control plate 34, the border sections 34' butt against associated borders 8' of the front sole holders 8, which are in the form of double levers according to FIG. 6, with the result that these are locked in their use position. When the standing and/or carrying plate 5 is pivoted sufficiently widely relative to the base plate, the control plate 34 executes a pivoting displacement of such a magnitude that one of the front sole holders 8 is freed from the associated border section 34' of the control plate 34 and, by way of its control-plate end, can slide onto the adjacent border section 34" and, accordingly, execute a pivoting movement into its release position. The kinematics between the yoke 31 and guide track or guide curve 33 here are such that, in the case of a corresponding pivoting displacement of the standing and/or carrying plate 5, that sole holder 8 which is arranged on that border side of the standing and/or carrying plate 5 which is oriented in the respective pivoting direction tilts, or can tilt, into its release position.

The second latching device 13, which controls the rear sole holders 9, has a helical compression spring 36, which is clamped in between an abutment 38, which can be displaced on the bottom part 5' of the standing and/or carrying plate 5 by means of an adjusting screw 37, and a piston 39, which can be displaced on the bottom plate part 5'. The threaded part of the adjusting screw 37 is connected in a non-rotatable and axially fixed manner to the abutment 38 and bears an adjusting nut 37' which is accessible from the outside and is mounted in an axially rotatable manner on the rear side of the standing and/or carrying plate 5, with the result that, by screwing adjustment of the adjusting nut 37' on the adjusting screw 37, it is possible to adjust the distance between the abutment 38 and the adjusting nut 37' and thus the prestressing of the helical compression spring 36.

On its end side which is directed toward the rear sole holders 9, the piston 39 has a track-like guide surface which interacts with a cam part, which cannot be seen in FIG. 7, and is arranged on a connecting component 40 which connects the rear sole holders 9 to one another in a rotationally fixed manner and may be integrally formed with the sole holders 9. The cam part and the curved surface here interact such that the piston 39, in the first instance, has to execute a comparatively large displacement counter to the compressive force of the helical spring 36 when the rear sole holders 9 are pivoted rearward by a comparatively small extent out of the use position, which is illustrated in FIG. 7. As the rear sole holders are pivoted further, they pass through a dead-center position between the cam part and track-like curved surface. Thereafter, the cam part of the rear sole holders 9 interacts with part of the curved surface such that the piston 39 is forced rearward by the helical compression spring 36 and the rear sole holders 9 are forced into their release position.

If required, it is also possible for the rear sole holders 9 to be disengaged manually or by means of a ski stick which, for this purpose, is positioned in a depression at the free end of the actuating lever 14 in order to press the lever 14 down toward the top side of the ski.

By virtue of the lever 14 being raised, it is possible for the rear sole holders 9 to be moved, if appropriate, manually into their use position.

It is also possible, when the boot is inserted, for the rear sole holders 9 to be adjusted from their release position into the use position by the boot. Stop steps 19' are formed on the rear recesses 19 of the boot sole 10 and interact with those borders of the rear sole holders 9 which are directed obliquely upward in FIG. 10, with the result that said sole holders are inevitably changed over into their use position when the boot is inserted, by way of the front fitting plate 18, into the front sole holders 8 and then is pushed down, by way of its heel region, against the top side of the standing and/or carrying plate 5. The binding according to the invention is thus designed as a so-called step-in binding.

During skiing, the standing and/or carrying plate 5 is subjected to more or less large torques in respect of a transverse ski axis. When the skier is in a forwardly inclined position, the front end of the standing and/or carrying plate 5 is forced against the top side of the ski. When the skier, in contrast, is in a rearwardly inclined position, the standing and/or carrying plate 5 is subjected to forces and moments which try to raise up the front end of this plate 5 from the ski 1.

Correspondingly oppositely directed forces arise at the rear end of the standing and/or carrying plate 5.

According to an advantageous embodiment of the invention, then, it is possible to provide a torque support 41 by means of which torques which act on the standing and/or carrying plate 5 in respect of the transverse axis are converted into torques in respect of the vertical axis.

Figure 8:
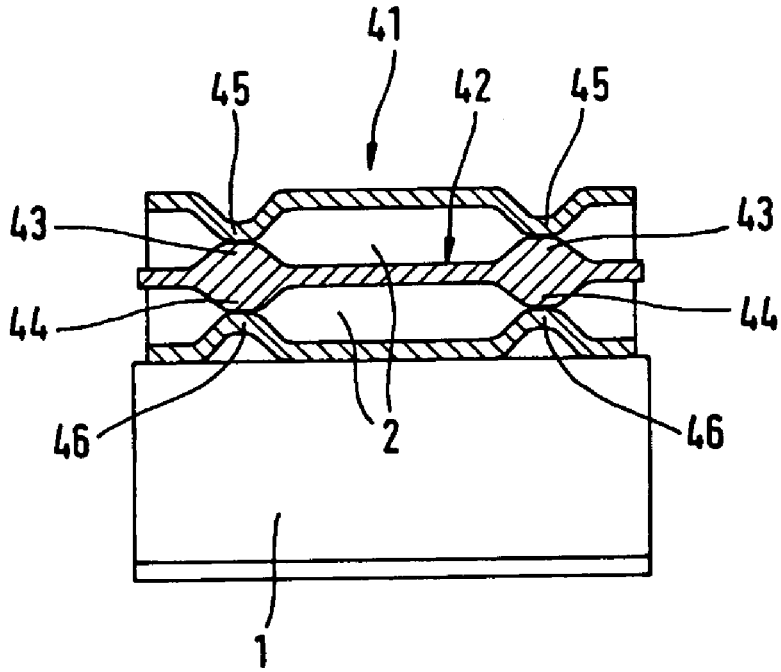
FIG. 8 shows a schematic sectional illustration of a torque support of the standing and/or carrying plate.

As can be gathered from the sectional view of FIG. 8, a profiled strip 42 is firmly arranged on the standing and/or carrying plate 5, this strip extending in the transverse direction of the plate and having, both on its top side and on its underside, in each case two respective elevations 43 and 44, with lateral oblique flanks, and also a horizontal section extending therebetween. Mating elevations 45 and 46 which interact with the elevations 43 and 44 are arranged on the base plate 2.

In FIG. 8, then, the position of the elevations 43 and 44, relative to the mating elevations 45 and 46, are illustrated for the (normal) case where the standing and/or carrying plate 5 assumes its normal, non-pivoted position relative to the base plate 2, i.e. the longitudinal axes of the two plates 2 and 5 coincide with one another in a plan view of the ski 1. In this case, the horizontal sections of the elevations 43 and 44 rest on the corresponding sections of the mating elevations 45 and 46. Irrespective of the magnitude of any possible vertical forces which try to force the front end of the standing and/or carrying plate 5 against the top side of the ski, or try to raise it up from the top side of the ski, and thus result in corresponding pressing forces between the horizontal sections of the mutually opposite elevations 43 to 46, it is not then possible to produce any active torque which tries to rotate the standing and/or carrying plate 5 about its vertical axis. If, however, the standing and/or carrying plate 5 is pivoted some way about the vertical axis counter to the resistance of the first latching device 7, it is possible for the oblique flanks of the mutually opposite elevations 43 to 46 to interact with one another, this resulting in the production of a torque about the abovementioned vertical axis as soon as the front end of the standing and/or carrying plate 5 is forced downward, or raised upward, with the profiled strip 42.

This results in the situation where, when the skier falls in the forward or rearward direction, the standing and/or carrying plate is subjected to an additional torque with respect to the vertical axis as soon as the standing and/or carrying plate 5 has already been deflected out of its central position by a certain extent.

This additional torque counteracts the restoring forces produced by the first latching device 7, with the result that the standing and/or carrying plate 5 can be moved more easily into the rotary position in which a front boot and/or sole holder 8 is unlocked and the boot is disengaged from the binding.

In contrast to the illustration in FIG. 2, it is also possible for the bearing part 4, if appropriate, to be of adjustable design, such that it releases the rear end of the base plate 2 in a release position and the base plate 2, accordingly, can be pivoted up, together with the standing and/or carrying plate 5, about the hinge pin of the bearing part 3. It is thus also possible for the binding according to the invention to be used, if appropriate, as a binding for cross-country skis.

In the case of the embodiment illustrated in the drawing, the front sole holders 8 can be pivoted about axes extending in the longitudinal direction of the standing and/or carrying plate 5. It is also possible, in principle, to provide front sole holders which can be pivoted about vertical and/or oblique axes.

The invention has been described with particular emphasis on the preferred embodiments. It should be appreciated that these embodiments are described for purposes of illustration only, and that numerous alterations and modifications may be practiced by those skilled in the art without departing from the spirit and scope of the invention. It is intended that all such modifications and alterations be included insofar as they come within the scope of the invention or the equivalents thereof.

The invention claimed is:

1. A disengageable ski binding having a standing and/or carrying plate provided as a standing surface for a ski boot and arranged on a base part mounted or secured firmly on the ski, said standing and/or carrying plate being rotatable about a vertical axis of the base part, counter to an adjustable resistance of a first latching device, and said standing and/or carrying plate having disengageable front and rear boot and/or sole holders arranged on the standing and/or carrying plate, said front and rear boot and/or sole holders being interactable in a form-fitting manner with mating surfaces or elements on the boot and/or boot sole, said surfaces or elements firmly fixable on the standing and/or carrying plate, the rear sole holders being adjustable into a release position counter to the adjustable resistance of a second latching arrangement separate from the first latching device without any lifting of the standing and/or carrying plate, the standing and/or carrying plate not establishing a clearance for rotation when the rear sole holders are adjusted in the release position to prevent dirt to be present between the standing and/or carrying plate and a ski boot sole, the front boot and/or sole holders being lockable within a predetermined angle-of-rotation region of the standing and/or carrying plate, at least essentially without affecting the resistance of the first latching device, and being unlocked outside the region of rotation.

2. The ski binding as claimed in claim 1, wherein the rear sole holders are disengageable only in the vertical direction.

3. The ski binding as claimed in claim 1, wherein the rear boot and/or sole holders have a latchable release position, the rear boot and/or sole holders being adjustable when in the latchable release position into the use position, when the skier steps into the binding, by interaction with at least one stop on the boot.

4. The ski binding as claimed in claim 1, wherein the rear boot and/or sole holders are assigned a manually actuable actuating lever.

5. The ski binding as claimed in claim 1, wherein the rear boot and/or sole holders are pivotable about a transverse axis.

6. A disengageable ski binding having a standing and/or carrying plate provided as a standing surface for a ski boot and arranged on the base part mounted or secured firmly on the ski, said standing and/or carrying plate being rotatable about a vertical axis of the base part, counter to an adjustable resistance of a first latching device and said standing and/or carrying plate having disengageable front and rear boot and/or sole holders arranged on the standing and/or carrying plate, said front and rear boot and/or sole holders being interactable in a form-fitting manner with mating surfaces or elements on the boot and/or boot sole, said surfaces or elements firmly fixable on the standing and/or carrying plate, the rear sole holders being adjustable into a release position counter to the adjustable resistance of a second latching arrangement separate from the first latching device, the front boot, and/or sole holders being lockable within a predetermined angle-of-rotation region of the standing and/or carrying plate, at least essentially without affecting the resistance of the first latching device, and being unlocked outside the region of rotation, the standing and/or carrying plate on the base part being assigned a moment support for converting torques acting on the standing and/or carrying plate in respect of a transverse axis into torques in respect of the vertical axis of the standing and/or carrying plate, for assisting the standing and/or carrying plate to rotate further about the vertical axis, as soon as the standing and/or carrying plate leaves a central position, or a central position region, with rotation about its vertical axis.

7. The ski binding as claimed in claim 6, wherein the moment support is effective when the skier falls in the forward direction.

8. The ski binding as claimed in claim 6, wherein the moment support is effective when the skier falls in the rearward direction.

9. A disengageable ski binding having a standing and/or carrying plate provided as a standing surface for a ski boot and arranged on a base part mounted or secured firmly on the ski, said standing and/or carrying plate being rotatable about a vertical axis of the base part, counter to an adjustable resistance of a first latching device, and said standing and/or carrying plate having disengageable front and rear boot and/or sole holders arranged on the standing and/or carrying plate, the front boot and/or sole holders being arranged to be pivotable about essentially horizontal longitudinal axes and interactable in a form-fitting manner with mating surfaces or elements on the boot and/or boot sole, said surfaces or elements firmly fixable on the standing and/or carrying plate, the rear sole holders being adjustable into a release position counter to the adjustable resistance of a second latching arrangement separate from the first latching device, the front boot and/or sole holders being lockable within a predetermined angle-of-rotation region of the standing and/or carrying plate, at least essentially without affecting the resistance of the first latching device, and being unlocked outside the region of rotation.

10. A disengageable ski binding having a standing and/or carrying plate provided as a standing surface for a ski boot and arranged on a base part mounted or secured firmly on the ski, said standing and/or carrying plate rotatable about a vertical axis of the base part, counter to an adjustable resistance of a first latching device, and said standing and/or carrying plate having disengageable front and rear boot and/or sole holders arranged on the standing and/or carrying plate, the front boot and/or sole holders being arranged to be pivotable about essentially vertical axes and interactable in a form-fitting manner with mating surfaces or elements on the boot and/or boot sole, said surfaces or elements firmly fixable on the standing and/or carrying plate, the rear sole holders being adjustable into a release position counter to the adjustable resistance of a second latching arrangement separate from the first latching device, and the front boot and/or sole holders being lockable within a predetermined angle-of-rotation region of the standing and/or carrying plate, at least essentially without affecting the resistance of the first latching device, and being unlocked outside the region of rotation.

11. A disengageable ski binding having a standing and/or carrying plate provided as a standing surface for a ski boot and arranged on a base part mounted or secured firmly on the ski, said base part being a base part bearing the standing and/or carrying plate connected at the front end to a bearing part mountable or firmly fittable on the ski, and being pivotable about a transverse ski axis, and firmly arrestable on the ski at the rear end by means of a further bearing part, said standing and/or carrying plate being rotatable about a vertical axis of the base part, counter to an adjustable resistance of a first latching device, and said standing and/or carrying plate having disengageable front and rear boot and/or sole holders arranged on the standing and/or carrying plate, said front and rear boot and/or sole holders being interactable in a form-fitting manner with mating surfaces or elements on the boot and/or boot sole, said surfaces or elements firmly fixable on the standing and/or carrying plate, the rear sole holders being adjustable into a release position counter to the adjustable resistance of a second latching arrangement separate from the first latching device, the front boot and/or sole holders being lockable within a predetermined angle-of-rotation region of the standing and/or carrying plate, at least essentially without affecting the resistance of the first latching device, and being unlocked outside the region of rotation.

12. The ski binding as claimed in claim 11, wherein the further bearing part is adjustable between a locked position of the base part and an unlocked position of the base part.

13. A releasable ski binding for a ski boot, the ski boot having a ski boot sole having mating surfaces or elements, said ski boot binding comprising:

a base part having a vertical axis, said base part being mountable on a ski;

a standing and/or carrying plate for the ski boot to be stood upon, said standing and/or carrying plate being mounted on said base part;

a rear sole holder for holding the rear portion of the ski boot sole, said rear sole holder being rotatable on a transverse axis and being attached to said standing and/or carrying plate, said rear sole holder having a rear mating surface for mating with the mating surfaces or element on a ski boot sole;

a front sole holder for holding the forward portion of the ski boot sole, said front sole holder being mounted for rotation on an axis not parallel with the transverse axis of rotation of said rear sole holder, said front sole holder being located on said standing and/or carrying plate and having a front mating surface to mate with the mating surfaces or elements on a ski boot sole;

front sole holder disengagement structure releasable from a set condition for disengaging said front sole holder from a ski boot sole;

rear sole holder disengagement structure releasable from a set condition for disengaging said rear sole holder from a ski boot sole;

a latching assembly having at least one adjustable resistance operably connected to said front and rear sole holder disengagement structures rotationally actuatable for releasing said front sole holder disengagement structure and for releasing said rear sole holder disengaging structure, said front and rear sole holder disengagement structures being independent of each other; and said standing and/or carrying plate being rotatable about the vertical axis of the base part, counter to one of said at least one adjustable resistance of said latching assembly, wherein:

locking structure for locking said front sole holder within a predetermined angle-of-rotation region of said standing and/or carrying plate without affecting the resistance of said first latching device, and said locking structure increasing the torque for unlocking said front sole holder in response to the rotation of said standing and/or carrying plate outside the predetermined angle-of-rotation region; and said rear sole holder being releasable into a release position in response to vertical actuation of said latching assembly.

* * * * *